US011378266B2

(12) United States Patent
Jiang

(10) Patent No.: US 11,378,266 B2
(45) Date of Patent: Jul. 5, 2022

(54) LOW-NOISE LIGHT FIXTURE RESET STRUCTURE AND CONTROL METHOD THEREOF

(71) Applicant: Guangzhou Haoyang Electronic Co., Ltd., Guangdong (CN)

(72) Inventor: Weikai Jiang, Guangdong (CN)

(73) Assignee: GUANGZHOU HAOYANG ELECTRONIC CO., LTD.

( * ) Notice: Subject to any disclaimer, the term of this patent is extended or adjusted under 35 U.S.C. 154(b) by 0 days.

(21) Appl. No.: 17/407,319

(22) Filed: Aug. 20, 2021

(65) Prior Publication Data

US 2021/0381680 A1 Dec. 9, 2021

Related U.S. Application Data

(63) Continuation of application No. PCT/CN2021/074037, filed on Jan. 28, 2021.

(30) Foreign Application Priority Data

May 29, 2020 (CN) ..... 202010477381.8

(51) Int. Cl.
*F21V 21/30* (2006.01)
*F21V 23/04* (2006.01)
(Continued)

(52) U.S. Cl.
CPC ..... *F21V 21/30* (2013.01); *F21V 15/04* (2013.01); *F21V 23/0464* (2013.01);
(Continued)

(58) Field of Classification Search
CPC ..... F21V 21/30; F21V 15/04; F21V 23/0464; F21V 23/0485; F21V 23/0492; F21W 2131/406
See application file for complete search history.

(56) References Cited

U.S. PATENT DOCUMENTS 9,539,952 B2 * 1/2017 Gebhard ..... B60R 11/00
10,240,768 B1 3/2019 Foster
(Continued)

FOREIGN PATENT DOCUMENTS

CN 105650569 A 6/2016
CN 108843605 A 11/2018
(Continued)

OTHER PUBLICATIONS

International Search Report for PCT/CN2021/074037 dated Apr. 26, 2021; 5 pages.

*Primary Examiner* — William N Harris
(74) *Attorney, Agent, or Firm* — Lerner, David, Littenberg, Krumholz & Mentlik, LLP

(57) ABSTRACT

A low-noise light fixture reset structure includes a pivot shaft and a pivot member rotatably connected to the pivot shaft. The pivot shaft is fixedly connected with a drive wheel and is sleeved with a shifter lever on which a first detection marker is provided on the shifter lever. A first detector configured to detect the first detection marker is provided on the pivot member. A first limiting post configured to limit the shifter lever is also provided on the drive wheel. The pivot member is further provided with an elastic member capable of resisting against the shifter lever and a second limiting post that limits the shifter lever. The second limiting post, the elastic member, and the first limiting post do not interfere with each other during a relative movement between the pivot member and the pivot shaft.

11 Claims, 9 Drawing Sheets

(51) Int. Cl.
*F21V 15/04* (2006.01)
*F21W 131/406* (2006.01)

(52) U.S. Cl.
CPC ..... *F21V 23/0485* (2013.01); *F21V 23/0492* (2013.01); *F21W 2131/406* (2013.01)

(56) References Cited

U.S. PATENT DOCUMENTS

| | | | | |
|---|---|---|---|---|
| 2013/0201686 | A1* | 8/2013 | Dalsgaard | F16M 11/08 362/249.1 |
| 2013/0201703 | A1* | 8/2013 | Dalsgaard | F21V 21/26 362/427 |
| 2019/0309930 | A1* | 10/2019 | Ernst | F21V 21/06 |
| 2020/0400294 | A1* | 12/2020 | Jurik | F21V 21/15 |

FOREIGN PATENT DOCUMENTS

| | | | |
|---|---|---|---|
| CN | 109519895 | A | 3/2019 |
| CN | 209026761 | U | 6/2019 |
| CN | 111594808 | A | 8/2020 |

* cited by examiner

LOW-NOISE LIGHT FIXTURE RESET STRUCTURE AND CONTROL METHOD THEREOF

CROSS REFERENCE TO RELATED APPLICATIONS

The present application is a continuation of International Application No. PCT/CN2021/074037, filed on Jan. 28, 2021, which claims priorities from Chinese Patent Application No. 202010477381.8 filed on May 29, 2020, all of which are hereby incorporated herein by reference.

TECHNICAL FIELD

The present invention relates to the technical field of stage light fixtures, and specifically relates to a low-noise light fixture reset structure and a control method thereof.

BACKGROUND

A stage light fixture generally includes a support arm rotatably connected to a base and a light head rotatably connected to the support arm. When the stage light fixture is power-on reset, both the light head and/or the support arm is required to zero to clarify an initial position, and a mechanical limiting structure is required in both clockwise and counterclockwise directions to prevent infinite rotation of the light fixture and twisting off of an electronic line therein.

When the support arm of the stage light fixture is reset, the support arm firstly rotates in a predetermined direction until the limiting structure is met to stop rotation. At this time, a driving motor shaft of the support arm cannot continue to rotate, and thus a feedback device cannot normally feed back signals, and a system cannot receive normal signals from the feedback device, so that it is determined that the light fixture has reached a limiting position of the limiting structure, which is defined as the initial position.

However, this reset method has a relatively large deficiency. That is, the support arm bounces back after collision with the limiting structure at a certain speed, and then collides with the limiting structure again under the drive of a drive motor and bounces back again. This process is repeated multiple times and noise like "click, click, click . . . " is clearly generated.

SUMMARY

The present invention provides a low-noise light fixture reset structure that can avoid strongly collision with the limiting structure without noise generation when the light fixture is reset.

According to the present invention the low-noise light fixture reset structure includes a pivot shaft and a pivot member rotatably connected to the pivot shaft, in which the pivot member has a first rotation direction and a second rotation direction that are opposite in direction relative to the pivot shaft, the pivot shaft is connected with a relatively fixed drive wheel and is sleeved with a shifter lever that can freely rotate relative to the pivot shaft;

a first detection marker is provided on the shifter lever, and a first detector that detects the first detection marker is correspondingly provided on the pivot member;

a first limiting post that limits the shifter lever is also provided on the drive wheel, the pivot member is further provided with an elastic member capable of resisting against the shifter lever and a second limiting post that limits the shifter lever, an resisting end of the elastic member and the second limiting post are respectively located on two sides of the first detector, the second limiting post, the first detector, and the resisting end are sequentially provided in the first rotation direction, and the second limiting post, the elastic member and the first limiting post do not interfere with each other during a relative movement between the pivot member and the pivot shaft; and when one side of the shifter lever is blocked by the first limiting post and the other side of the shifter lever squeezes the elastic member, the elastic member deforms to the second rotation direction to cause the first detector to detect the first detection marker on the shifter lever.

The first limiting post of the low-noise light fixture reset structure is fixed to the drive wheel on the pivot shaft, all the second limiting post, the first detector and the elastic member are fixed to the pivot member, the pivot member has the first rotation direction and the second rotation direction that are opposite in direction, the shifter lever is sleeved on the pivot shaft and can freely rotate relative to the pivot shaft. Since the second limiting post, the first detector, and the resisting end of the elastic member are sequentially provided in the first rotation direction, when the pivot member is rotated in the first rotation direction relative to the pivot shaft, the resisting end of the elastic member can push the shifter lever to rotate together upon touching the shifter lever until one side of the shifter lever is blocked by the first limiting post. As the pivot member continues to rotate in the first rotation direction relative to the pivot shaft, the elastic member deforms to the second rotation direction to cause the first detector to detect the first detection marker on the shifter lever and generate a first reset signal, and then this position is defined as a preliminary initial position, which is taken as a reset position. Since the second limiting post is not required to touch the shifter lever resisted against by the first limiting post, the pivot member do not bounce back under the action of a reaction force, thereby avoiding noise like "click, click, click . . . " generated by multiple times of collision and creating a quieter reset process.

A second detection marker is provided on the drive wheel, and a second detector that detects the second detection marker is correspondingly provided on the pivot member. After the first detector detects that the first detection marker on the shifter lever generates the first reset signal, a system drives the pivot member to rotate in the second rotation direction relative to the pivot shaft, the resisting end of the elastic member resists against the shifter lever to cause the shifter lever to remain motionless, the first detector moves away from the first detection marker until the second detector detects the second detection marker on the drive wheel, then a second reset signal is generated, and this position is taken as a precise initial position. Due to the fact that the shifter lever is sleeved on the pivot shaft, the shifter lever may rotate with the pivot member relative to the pivot shaft because of a problem of friction force between the shifter lever and the pivot member, and that the reset is easy to deviate from a predetermined position if the preliminary initial position is taken as the reset position, thus the position at which the second detector generates the second reset signal for the first time is taken as the precise initial position, when, marked by the first reset signal, the pivot member rotates in the second rotation direction relative to the pivot shaft. When the precise initial position is taken as the reset position, the system is more stable without deviation, and the reset is more accurate.

On the pivot member, the second detector, the second limiting post, the first detector and the resisting end are sequentially provided in the first rotation direction, and on the drive wheel, the second detection marker and the first limiting post are also sequentially provided in the first rotation direction.

the second detection marker is a magnet, the second detector is a magnetic sensitive switch, and/or the first detection marker is a magnet, and the first detector is a magnetic sensitive switch. Magnetic induction is less susceptible to interference from acoustic, optical and non-magnetic material, which results in higher stability.

both the second detection marker and the second detector are located on one side of the drive wheel away from the shifter lever, and both the first detection marker and the first detector are located on one side of the shifter lever away from the drive wheel. In this manner, two detection systems are independent of each other to prevent the second detection marker from affecting the first detector and prevent the first detection marker from affecting the second detector.

A minimum distance between the second limiting post and a center of the pivot shaft, and a minimum distance between the elastic member and a center of the pivot shaft are greater than a maximum distance between the first limiting post and the center of the pivot shaft. Thus, when the second limiting post and the elastic member rotate together relative to the pivot shaft, the first limiting post cannot be touched, and relative rotation of the pivot member and the pivot shaft cannot be affected.

When the first detector detects the first detection marker, the second limiting post is not in contact with the shifter lever. That is, there is a distance between the second limiting post and the first detector such that the second limiting post cannot squeeze the shifter lever and emit collision noise when the first detector detects the first detection marker.

The pivot shaft is fixed to a position, and the pivot member self-rotates about the pivot shaft. The pivot member drives the second limiting post, the first detector and the elastic member that are provided on the pivot member to rotate together, while the pivot shaft and the drive wheel and the first limiting post that are provided on the pivot shaft remain motionless.

The pivot member is a support arm of a stage light fixture or a light head of a stage light fixture. A stage light fixture generally includes a support arm rotatably connected to a base and a light head rotatably connected to the support arm. The low-noise light fixture reset structure can be used on the reset structure of the support arm and on the reset structure of the light head.

The present invention also provides a control method of any of the low-noise light fixture reset structures described above, including the following steps:

S1, driving the pivot member to rotate in the first rotation direction relative to the pivot shaft such that the resisting end of the elastic member pushes the shifter lever to rotate together until one side of the shifter lever is blocked by the first limiting post;

S2, continuing to drive the pivot member to rotate in the first rotation direction relative to the pivot shaft, the other side of the shifter lever resisting against the resisting end to deform the elastic member to the second rotation direction, thereby causing the first detector to detect the first detection marker on the shifter lever and generate the first reset signal; and S3, driving the pivot member to rotate in the second rotation direction relative to the pivot shaft, the resisting end of the elastic member resisting against the shifter lever to remain motionless, and the first detector moving away from the first detection marker to complete a reset.

Since the second limiting post is not required to touch the shifter lever resisted against by the first limiting post, the pivot member do not bounce back under the action of a reaction force, thereby avoiding noise like "click, click, click . . . " generated by multiple times of collision and creating a quieter reset process.

A second detection marker is provided on the drive wheel, and a second detector that detects the second detection marker is correspondingly provided on the pivot member; and in step S3, after the first detector is moved away from the first detection marker, the pivot member is continued to be driven to rotate in the second rotation direction relative to the pivot shaft until the second detector detects the second detection marker on the drive wheel, and then a second reset signal is generated to complete a reset.

Due to the fact that the shifter lever is sleeved on the pivot shaft, the shifter lever may rotate with the pivot member relative to the pivot shaft because of a problem of friction force between the shifter lever and the pivot member, and that the reset is easy to deviate from a predetermined position if the position of the first detection marker on the shifter lever detected by the first detector is taken as the reset position, thus the position at which the second detector generates the second reset signal for the first time is taken as the precise initial position, when, marked by the first reset signal, the pivot member rotates in the second rotation direction relative to the pivot shaft. When the precise initial position is taken as the reset position, the system is more stable without deviation, and the reset is more accurate.

REFERENCE NUMERALS

Figure 1:
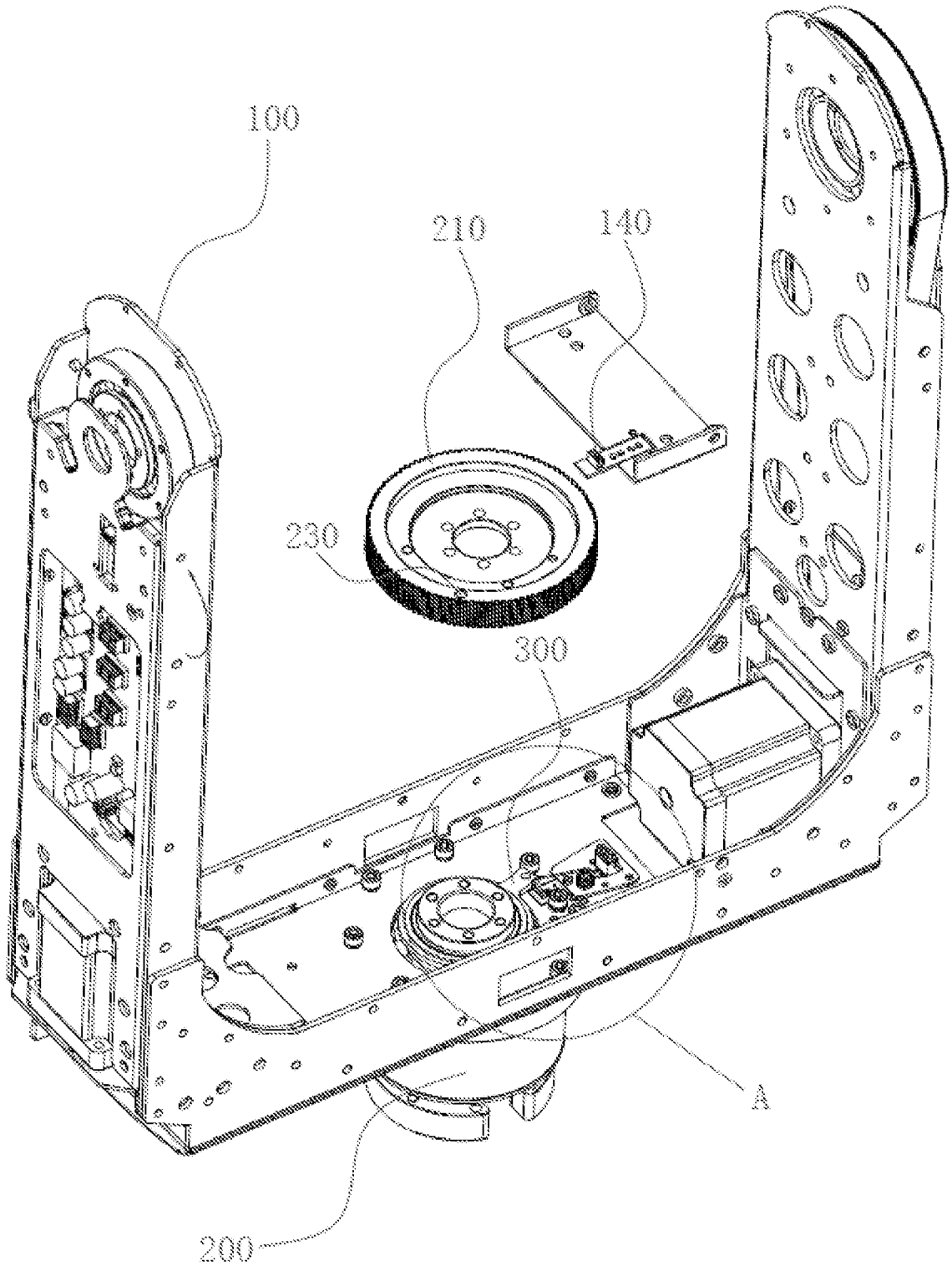
FIG. 1 is an exploded structural schematic diagram of a low-noise light fixture reset structure according to the present invention.

100, pivot member; 110, first detector; 120, second limiting post; 130, elastic member; 140, second detector; 200, pivot shaft; 210, drive wheel; 220, first limiting post; 230, second detection marker; 300, shifter lever; 310, first detection marker; 320, limiting tube.

DETAILED DESCRIPTION

The drawings are for illustration purpose only and are not intended to limit the present patent. Some components in the drawings may be omitted, enlarged or reduced for better illustrating the embodiments, and sizes of these components do not represent that of an actual product. For those skilled in the art, it will be understood that some known structures in the drawings and descriptions thereof may be omitted. The description of positional relationship in the drawings is for illustration purpose only and is not intended to limit the present patent.

Figure 2:
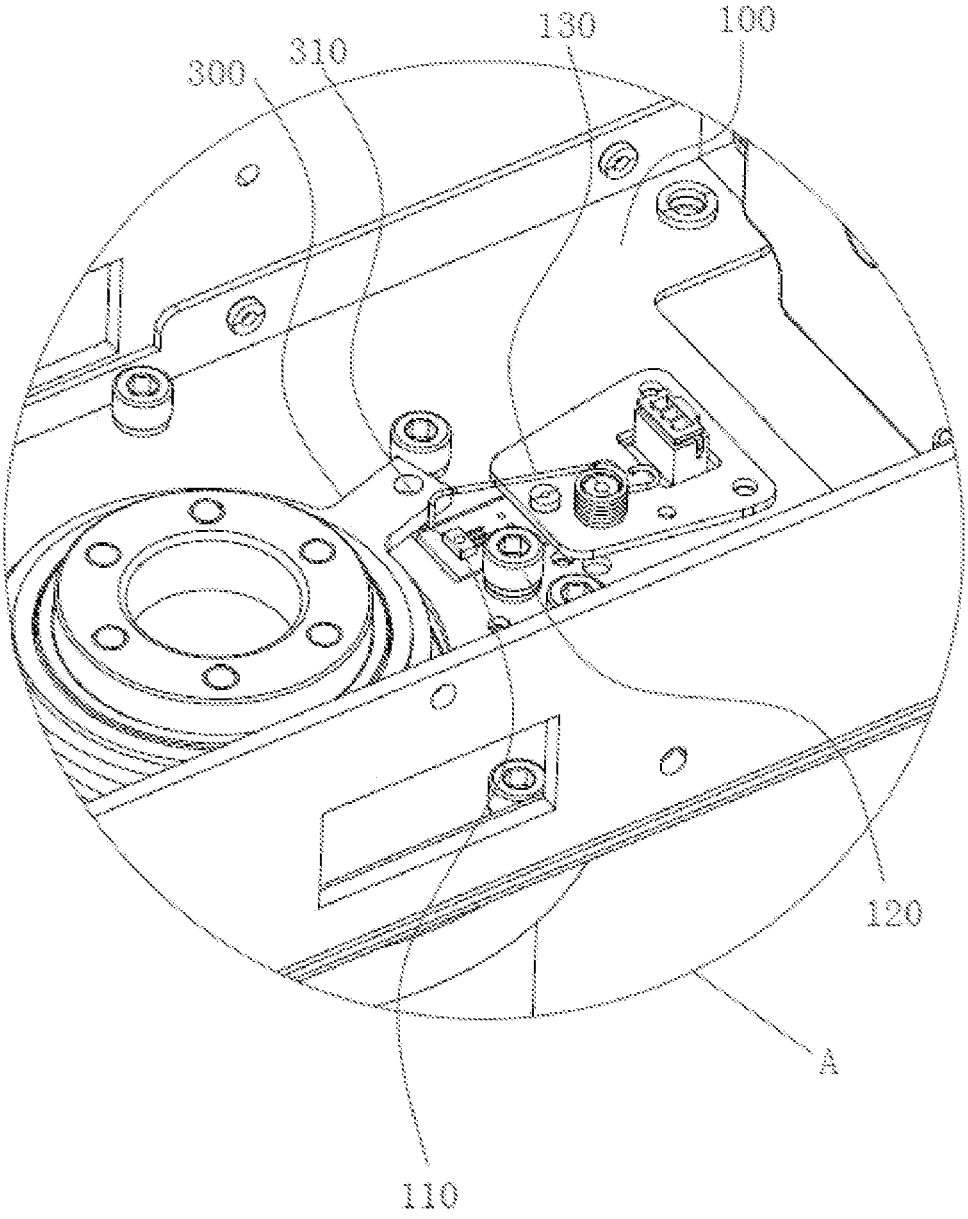
FIG. 2 is an enlarged view of position A of FIG. 1.
Figure 3:
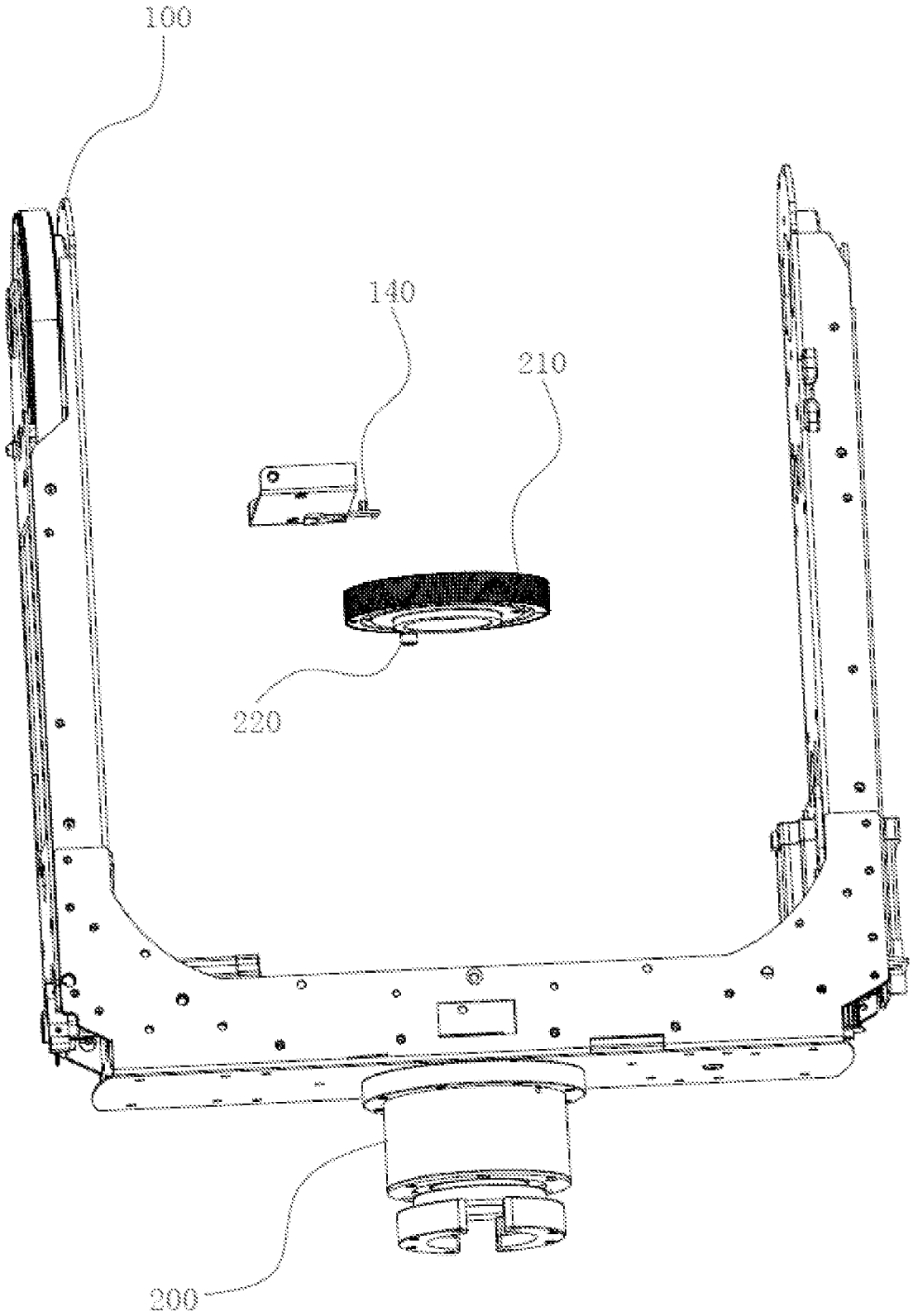
FIG. 3 is an another exploded structural schematic diagram of the low-noise light fixture reset structure according to the present invention.

As shown in FIGS. 1 to 3, a low-noise light fixture reset structure is provided including a pivot shaft 200 and a pivot member 100 rotatably connected to the pivot shaft 200. The pivot member 100 has a first rotation direction and a second rotation direction that are opposite in direction relative to the pivot shaft 200. The pivot shaft 200 is connected with a fixed drive wheel 210 relative to the pivot shaft 200 and is sleeved with a shifter lever 300 that can freely rotate relative to the pivot shaft 200.

A first detection marker 310 is provided on the shifter lever 300, and a first detector 110 configured to detect the first detection marker 310 is correspondingly provided on the pivot member 100.

A first limiting post 220 configured to limit the shifter lever 300 is also provided on the drive wheel 210. The pivot member 100 is further provided with an elastic member 130 capable of resisting against the shifter lever 300 and a second limiting post 120 that limits the shifter lever 300. An resisting end of the elastic member 130 and the second limiting post 120 are respectively located on two sides of the first detector 110, and the second limiting post 120, the first detector 110 and the resisting end are sequentially provided in the first rotation direction. The second limiting post 120, the elastic member 130, and the first limiting post 220 do not interfere with each other during a relative movement between the pivot member 100 and the pivot shaft 200.

When one side of the shifter lever 300 is blocked by the first limiting post 220 and the other side of the shifter lever 300 squeezes the elastic member 130, the elastic member 130 deforms to the second rotation direction (i.e., a direction close to the second limiting post 120) to cause the first detector 110 to detect the first detection marker 310 on the shifter lever 300.

Figure 5:
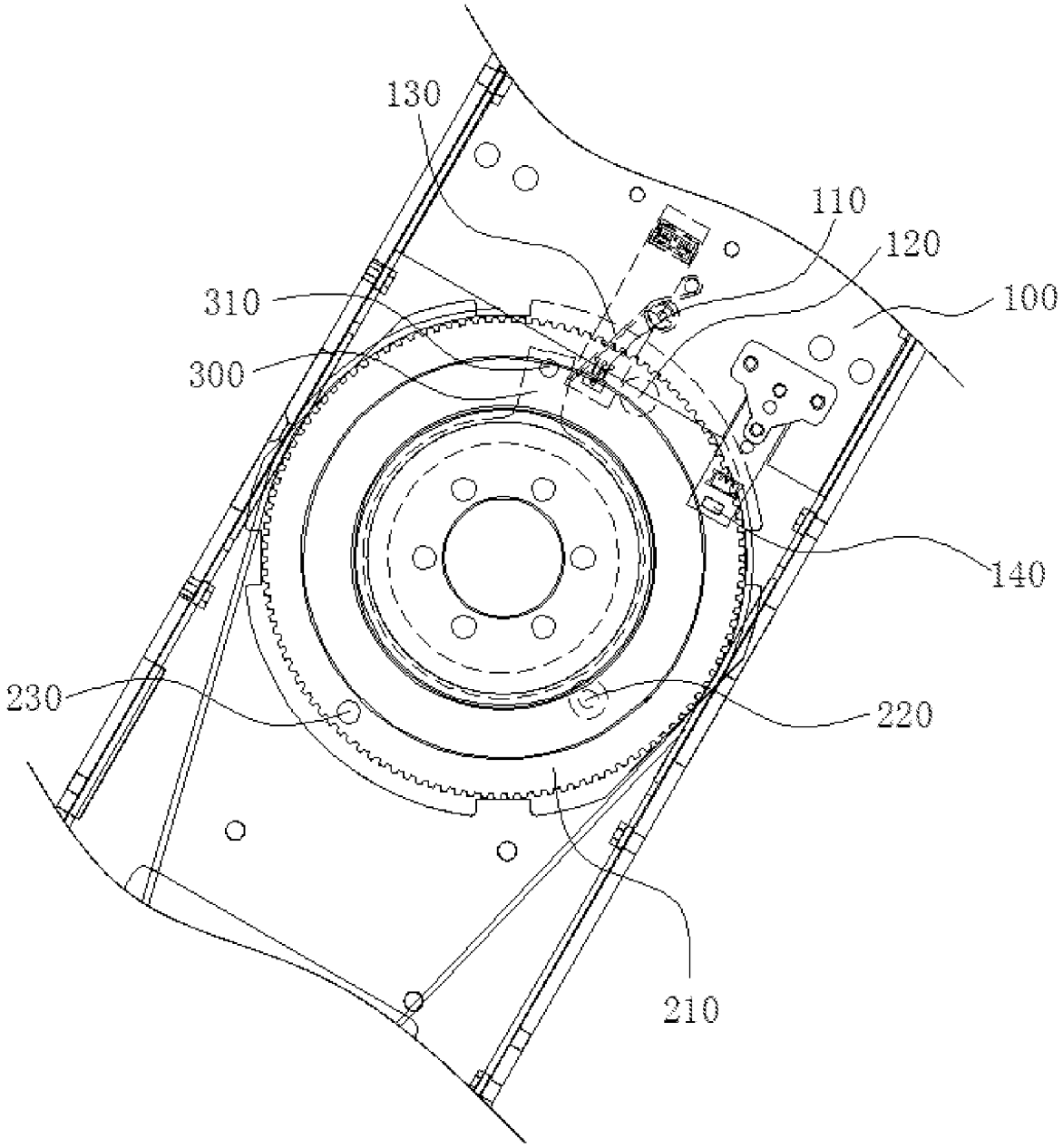
FIG. 5 is a schematic structural view when a pivot member is in a first position relative to a pivot shaft according to the present invention.
Figure 6:
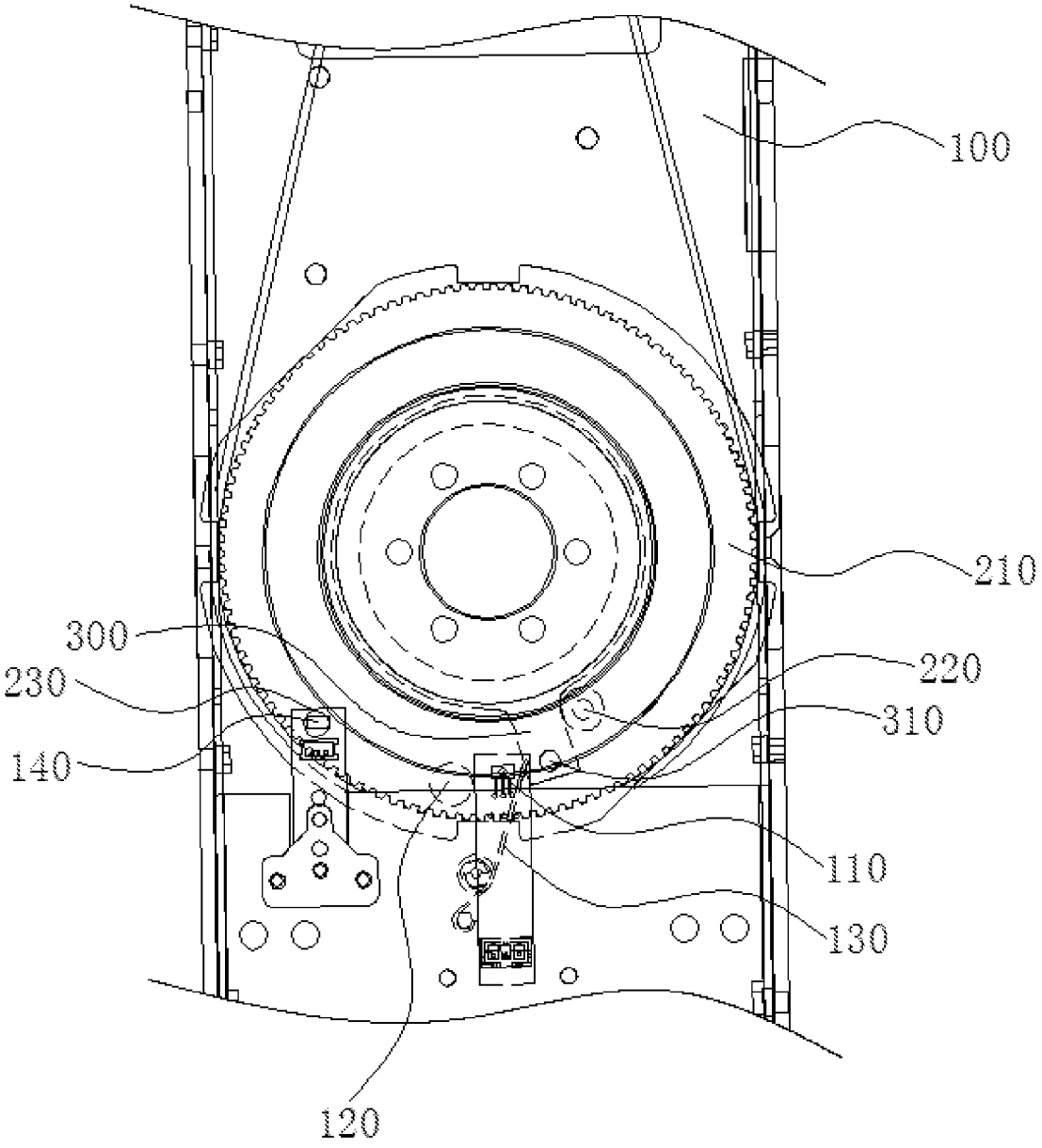
FIG. 6 is a schematic structural view when the pivot member is in a second position relative to the pivot shaft according to the present invention.
Figure 7:
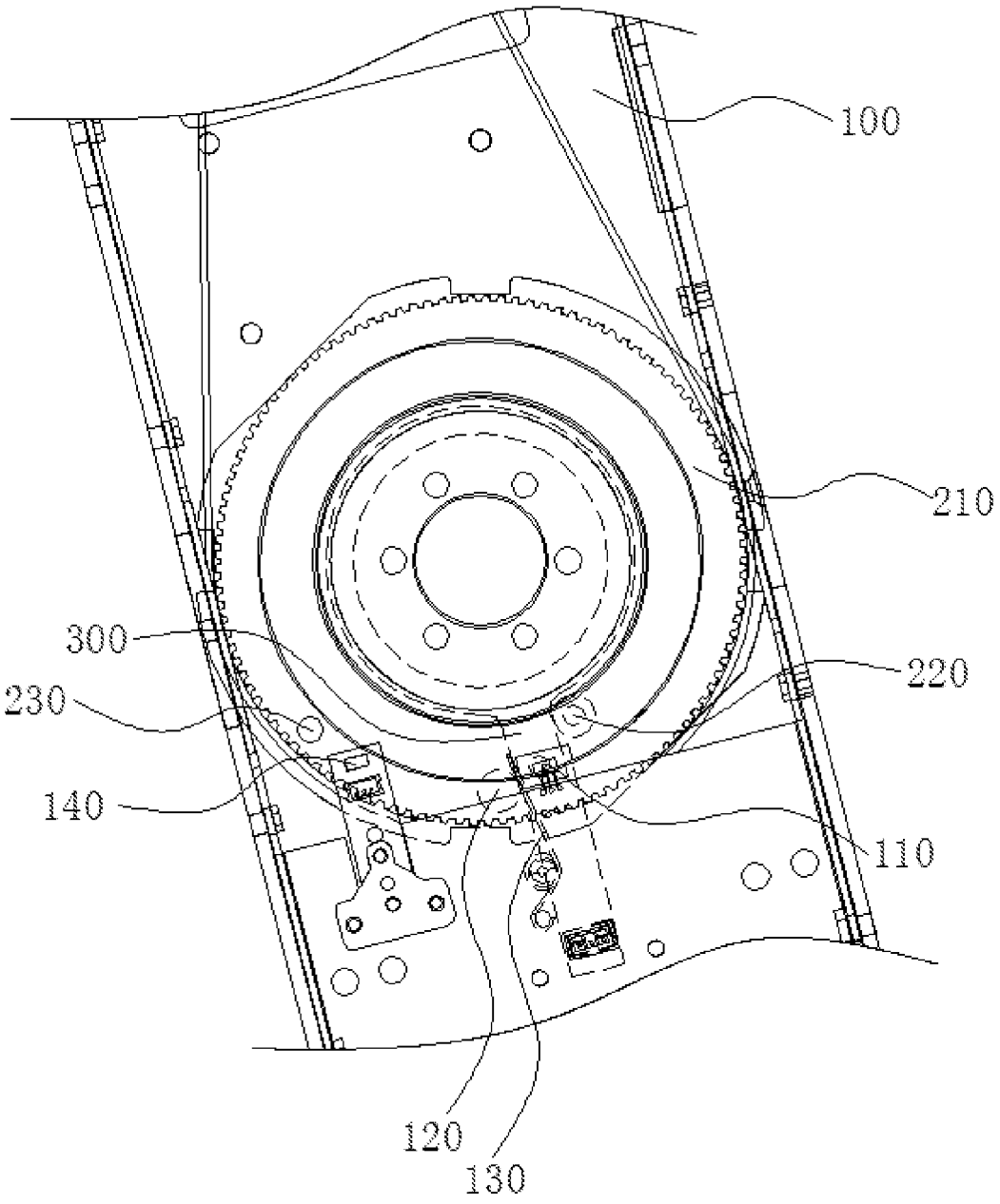
FIG. 7 is a schematic structural view when the pivot member is in a third position relative to the pivot shaft according to the present invention.

According to the present invention, the first limiting post 220 of the low-noise light fixture reset structure is fixed to the drive wheel 210 on the pivot shaft 200, the second limiting post 120, the first detector 110 and the elastic member 130 are all fixed to the pivot member 100, the pivot member 100 has the first rotation direction and the second rotation direction that are opposite in direction relative to the pivot shaft 200, and the shifter lever 300 is sleeved on the pivot shaft 200 and can freely rotate relative to the pivot shaft 200. Since the second limiting post 120, the first detector 110, and the resisting end of the elastic member 130 are sequentially provided in the first rotation direction, when the pivot member 100 is rotated in the first rotation direction relative to the pivot shaft 200 (as shown in FIG. 5), the resisting end of the elastic member 130 can push the shifter lever 300 to rotate together upon touching the shifter lever 300 until one side of the shifter lever 300 is blocked by the first limiting post 220 (as shown in FIG. 6). As the pivot member 100 continues to rotate in the first rotation direction relative to the pivot shaft 200, the elastic member 130 deforms to the second rotation direction to cause the first detector 110 to detect the first detection marker 310 on the shifter lever 300 (as shown in FIG. 7) to generate a first reset signal, and this position is defined as a preliminary initial position, which is taken as a reset position. Since the second limiting post 120 is not required to touch the shifter lever 300 resisted against by the first limiting post 220, the pivot member 100 do not bounce back under the action of a reaction force, thereby avoiding noise like "click, click, click . . . " generated by multiple times of collision and creating a quieter reset process.

If the pivot member 100 continues to rotate in the first rotation direction relative to the pivot shaft 200, the second limiting post 120 may resist against the shifter lever 300. In addition, due to the fact that the other side of the shifter lever 300 is blocked by the first limiting post 220, the pivot member 100 cannot continue to rotate relative to the pivot shaft 200, at which time a minimum relative rotation angle is reached.

Optionally, the first rotation direction refers to a counter-clockwise direction, and the second rotation direction refers to a clockwise direction.

Optionally, the drive wheel 210 is a synchronizing wheel and is driven by a synchronous belt.

Optionally, the elastic member 130 is an end-bent elastic piece, and a bent portion forms the resisting end.

Figure 4:
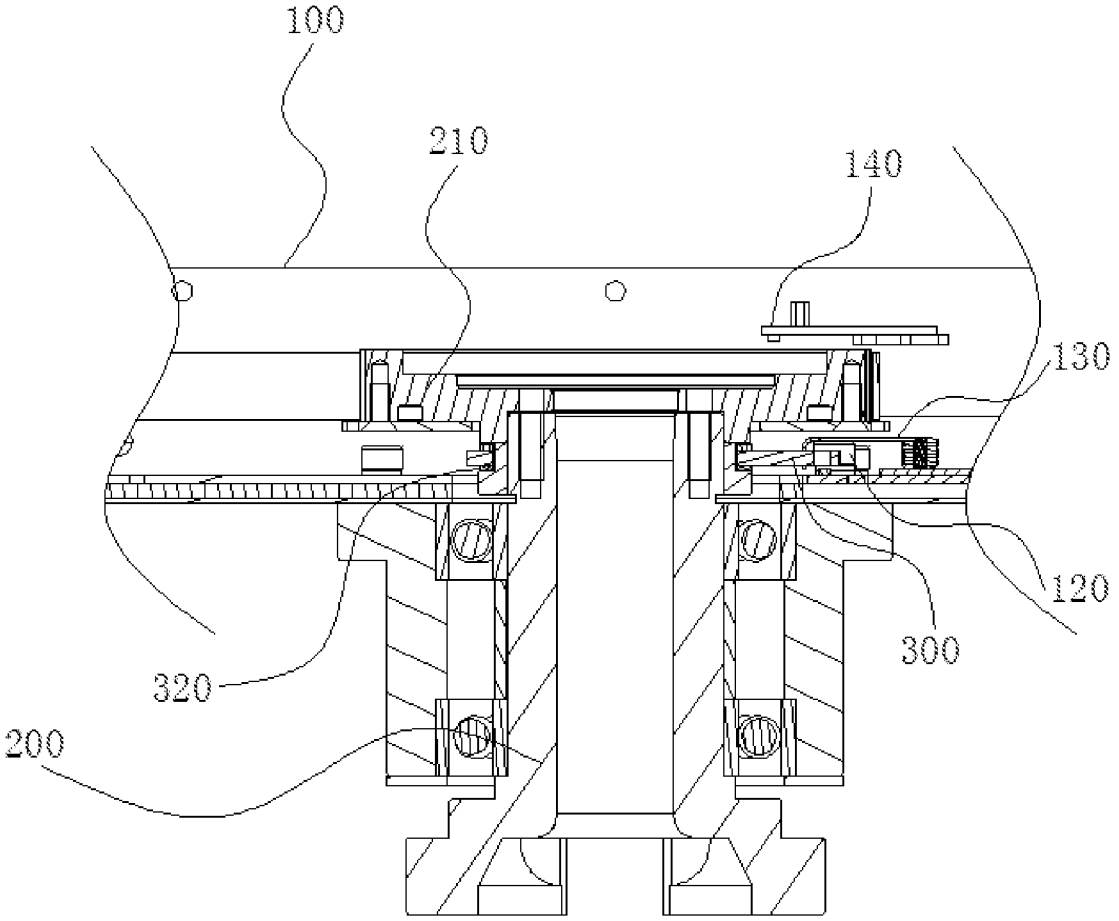
FIG. 4 is a partial cross-sectional view of the low-noise light fixture reset structure according to the present invention.

Optionally, as shown in FIG. 4, the shifter lever 300 is sleeved on a limiting tube 320 having blocking portions at two ends that prevents the shifter lever 300 from swaying along a length direction of the limiting tube 320, in which the limiting tube 320 is sleeved on the pivot shaft 200.

Figure 8:
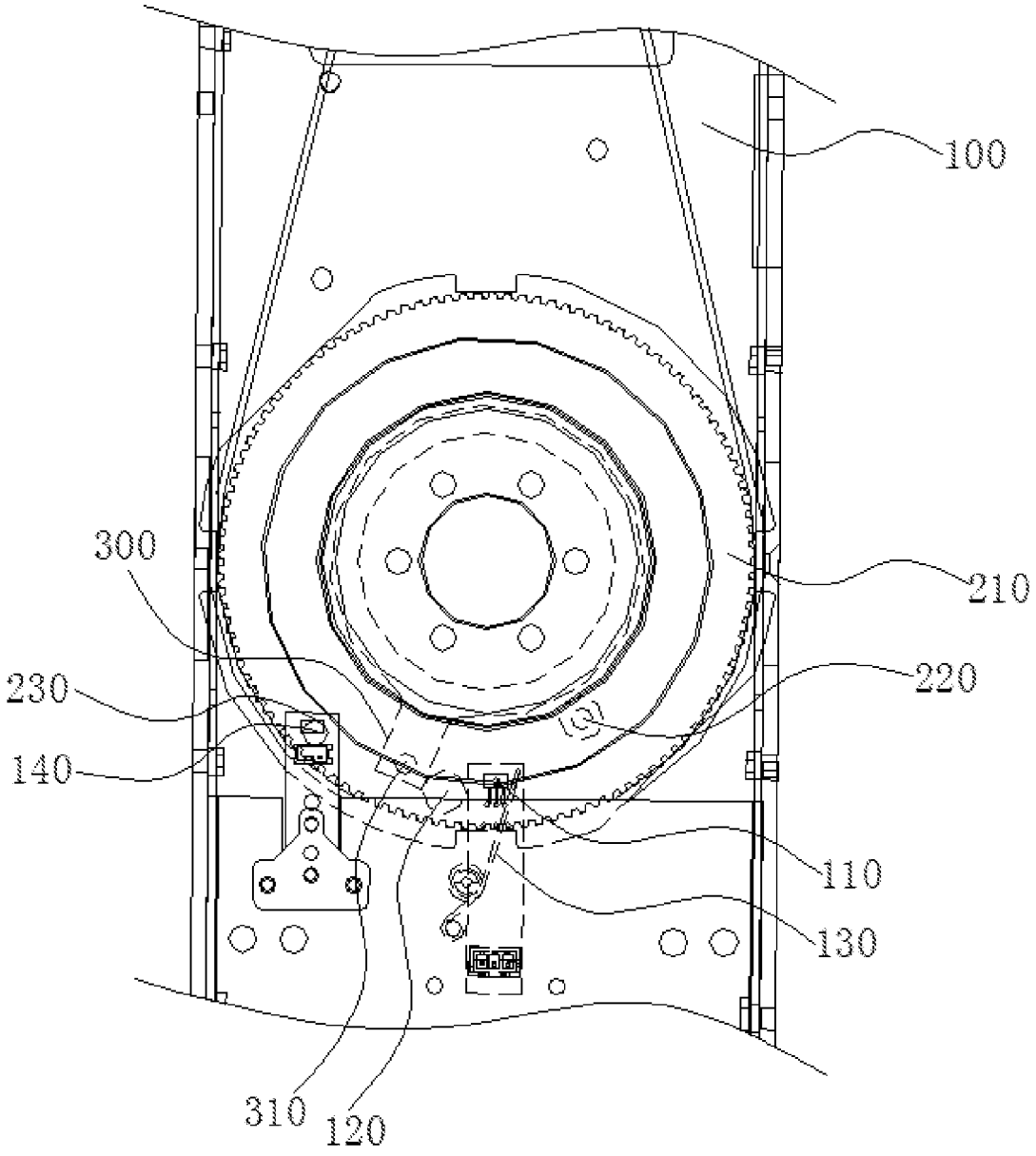
FIG. 8 is a schematic structural view when the pivot member is in a fourth position relative to the pivot shaft according to the present invention.

In a preferred embodiment of the present invention, a second detection marker 230 is provided on the drive wheel 210, and a second detector 140 configured to detect the second detection marker 230 is correspondingly provided on the pivot member 100. After the first detector 110 detects that the first detection marker 310 on the shifter lever 300 generates the first reset signal (as shown in FIG. 7), the system drives the pivot member 100 to rotate in the second rotation direction relative to the pivot shaft 200, the resisting end of the elastic member 130 resists against the shifter lever 300 to cause the shifter lever 300 to remain motionless, the first detector 110 moves away from the first detection marker 310 until the second detector 140 detects the second detection marker 230 on the drive wheel 210 (as shown in FIG. 8), then a second reset signal is generated, and this position is taken as a precise initial position. Due to the fact that the shifter lever 300 is sleeved on the pivot shaft 200, the shifter lever 300 may rotate with the pivot member 100 relative to the pivot shaft 200 because of a problem of friction force between the shifter lever 300 and the pivot member 100, and that the reset is easy to deviate from a predetermined position if the preliminary initial position is taken as the reset position, thus the position at which the second detector 140 generates the second reset signal for the first time is taken as the precise initial position, when, marked by the first reset signal, the pivot member 100 rotates in the second rotation direction relative to the pivot shaft 200. When the precise initial position is taken as the reset position, the system will be more stable without deviation, and the reset is more accurate.

Figure 9:
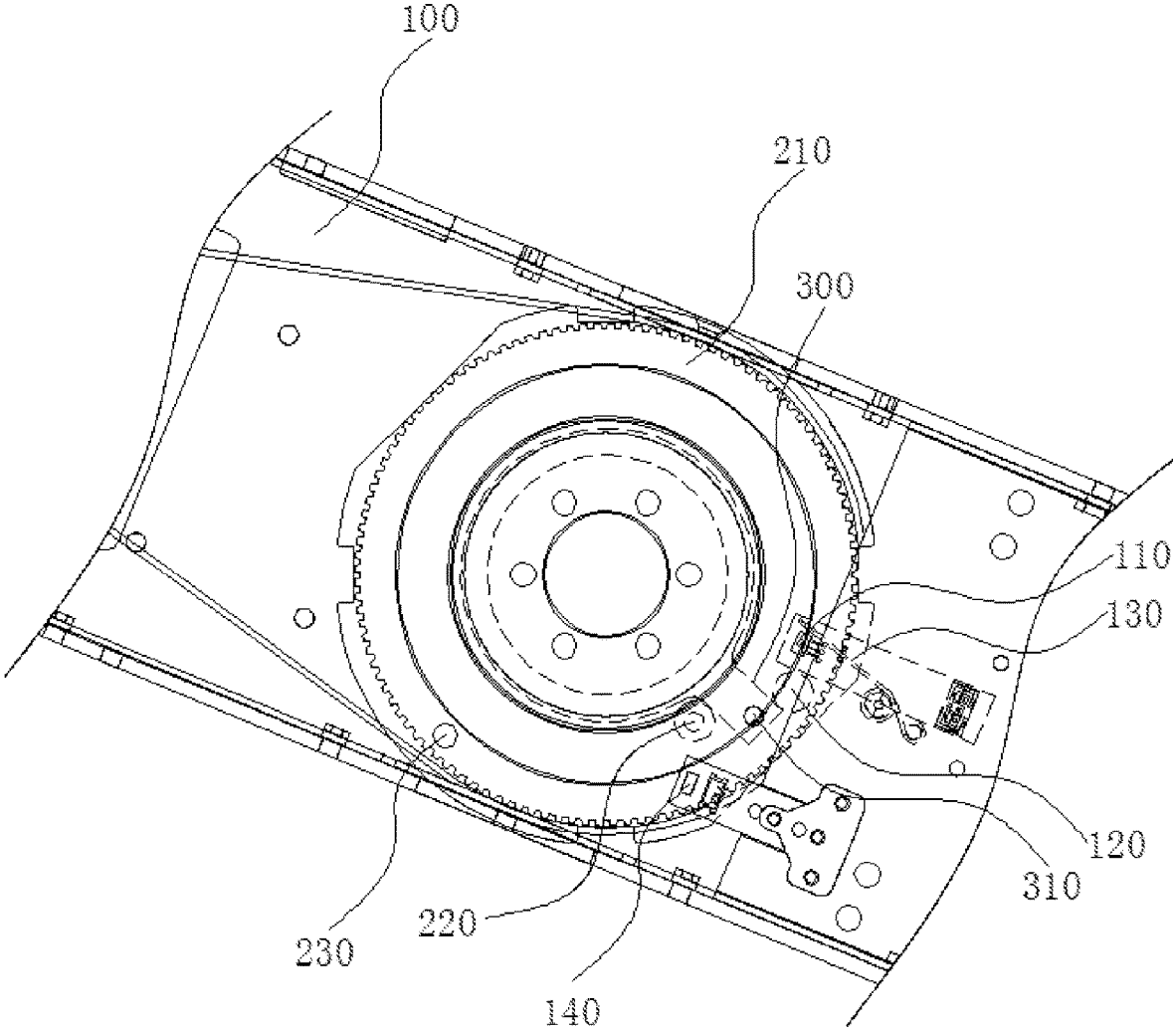
FIG. 9 a schematic structural view when the pivot member is in a fifth position relative to the pivot shaft according to the present invention.

The pivot member 100 is continued to be driven to rotate in the second rotation direction relative to the pivot shaft 200. After the pivot member 100 is rotated approximately 360° in the second rotation direction relative to the pivot shaft 200, the second limiting post 120 can push the shifter lever 300 to rotate together, and finally the shifter lever 300 can be blocked by the first limiting post 220 (as shown in FIG. 9), thereby limiting the pivot member 100 to continue rotation relative to the pivot shaft 200, at which time a maximum relative rotation angle is reached.

In a preferred embodiment of the present invention, on the second detector 140, the pivot member 100, the second limiting post 120, the first detector 110 and the resisting end are sequentially provided in the first rotation direction, and on the drive wheel 210, the second detection marker 230 and the first limiting post 220 are also sequentially provided in the first rotation direction. At this time, a sector central angle centered on a center of the pivot shaft 200 from the second detection marker 230 to the first limiting post 220 in the first rotation direction is less than 180°.

Further, taking the center of the pivot shaft 200 as a center, a sector central angle from the second detection marker 230 to the first limiting post 220 in the first rotation direction is less than 120° and preferably 60°, and when the first detection marker 310 on the shifter lever 300 is detected by the first detector 110, the central angle between the second detection marker 230 and the first detector 110 is greater than that between the second detector 140 and the first detector 110. Thus, after the first detector 110 detects that the first detection marker 310 on the shifter lever 300 generates the first reset signal, the pivot member 100 is only required to rotate a smaller angle relative to the pivot shaft 200 in the second rotation direction to achieve detection of the second detection marker 230, so that the reset is quicker.

In a preferred embodiment of the present invention, the second detection marker 230 is a magnet, the second detector 140 is a magnetic sensitive switch, and/or the first detection marker 310 is a magnet, and the first detector 110 is a magnetic sensitive switch. Magnetic induction is less susceptible to interference from acoustic, optical and non-magnetic material, which results in higher stability.

In other embodiments, the second detection marker 230 and/or the first detection marker 310 can also be a color marker, a touch point, or the like, and the second detector 140 and/or the first detector 110 can correspond to a light intensity sensor, a touch switch light, or the like.

When the second detection marker 230 and the first detection marker 310 are both magnets while the second detector 140 and the first detector 110 are both magnetic sensitive switches, the second detection marker 230 and the first detection marker 310 have different spacings from the center of the pivot shaft 200 to avoid interaction between each other. When the second detection marker 230 and the first detection marker 310 are of different types, the second detection marker 230, the first detection marker 310 can have the same spacing from the center of the pivot shaft 200.

In a preferred embodiment of the present invention, both the second detection marker 230 and the second detector 140 are located on one side of the drive wheel 210 away from the shifter lever 300, and both the first detection marker 310 and the first detector 110 are located on one side of the shifter lever 300 away from the drive wheel 210. In this manner, two detection systems are independent of each other to prevent the second detection marker 230 from affecting the first detector 110 and prevent the first detection marker 310 from affecting the second detector 140.

In a preferred embodiment of the present invention, a minimum distance between the second limiting post 120 and the center of the pivot shaft 200, and a minimum distance between the elastic member 130 and the center of the pivot shaft 200 are greater than a maximum distance between the first limiting post 220 and the center of the pivot shaft 200. Thus, when the second limiting post 120 and the elastic member 130 rotate together relative to the pivot shaft 200, the first limiting post 220 cannot be touched, and relative rotation of the pivot member 100 and the pivot shaft 200 cannot be affected. In other embodiments, a minimum distance between the first limiting post 220 and the center of the pivot shaft 200 is greater than a maximum distance between the second limiting post 120 and the center of the pivot shaft 200.

In a preferred embodiment of the present invention, when the first detector 110 detects the first detection marker 310, the second limiting post 120 is not in contact with the shifter lever 300. That is, there is a distance between the second limiting post 120 and the first detector 110 such that the second limiting post 120 cannot squeeze the shifter lever 300 and emit collision noise when the first detector 110 detects the first detection marker 310. In the present embodiment, the second limiting post 120 is in close proximity to the first detector 110.

In a preferred embodiment of the present invention, the pivot shaft 200 is fixed to a position, and the pivot member 100 self-rotates about the pivot shaft 200. The pivot member 100 drives the second limiting post 120, the first detector 110, and the elastic member 130 that are provided on the pivot member 100 to rotate together, while the pivot shaft 200 and the drive wheel 210 and the first limiting post 220 that are provided on the pivot shaft 200 remain motionless. In other embodiments, the pivot member 100 can remain motionless while the pivot shaft 200 drives the drive wheel 210 and the first limiting post 220 to rotate.

In a preferred embodiment of the present invention, the pivot member 100 is a support arm of a stage light fixture or a light head of a stage light fixture. A stage light fixture generally includes a support arm rotatably connected to a base and a light head rotatably connected to the support arm. The low-noise light fixture reset structure can be used on the reset structure of the support arm and on the reset structure of the light head.

The present invention also provides a control method of any of the low-noise light fixture reset structures described above, including the following steps:

S1, driving the pivot member 100 to rotate in the first rotation direction relative to the pivot shaft 200 such that the resisting end of the elastic member 130 pushes the shifter lever 300 to rotate together until one side of the shifter lever 300 is blocked by the first limiting post 220;

S2, continuing to drive the pivot member 100 to rotate in the first rotation direction relative to the pivot shaft 200, the other side of the shifter lever 300 resisting against the resisting end to deform the elastic member 130 to the second rotation direction, thereby causing the first detector 110 to detect the first detection marker on the shifter lever 300 and generate the first reset signal; and S3, driving the pivot member 100 to rotate in the second rotation direction relative to the pivot shaft 200, the resisting end of the elastic member 130 resists against the shifter lever 300 to remain motionless, and the first detector 110 moving away from the first detection marker 310 to complete a reset.

Since the second limiting post 120 is not required to touch the shifter lever 300 resisted against by the first limiting post 220, the pivot member 100 do not bounce back under the action of a reaction force, thereby avoiding noise like "click, click, click . . . " generated by multiple times of collision and creating a quieter reset process.

In a preferred embodiment of the present invention, a second detection marker 230 is provided on the drive wheel 210, and a second detector 140 that detects the second detection marker 230 is correspondingly provided on the pivot member 100; and in step S3, after the first detector 110 is moved away from the first detection marker 310, the pivot member 100 is continued to be driven to rotate in the second rotation direction relative to the pivot shaft 200 until the second detector 140 detects the second detection marker 230 on the drive wheel 210, and then a second reset signal is generated to complete a reset.

Due to the fact that the shifter lever 300 is sleeved on the pivot shaft 200, the shifter lever 300 may rotate with the pivot member 100 relative to the pivot shaft 200 because of a problem of friction force between the shifter lever 300 and the pivot member 100, and that the reset is easy to deviate from a predetermined position if the position of the first detection marker 310 on the shifter lever 300 detected by the first detector 110 is taken as the reset position, thus the position at which the second detector 140 generates the second reset signal for the first time is taken as the precise initial position, when, marked by the first reset signal, the pivot member 100 rotates in the second rotation direction relative to the pivot shaft 200. When the precise initial position is taken as the reset position, the system is more stable without deviation, and the reset is more accurate.

Obviously, the above embodiments of the invention are merely examples for clear illustration of the invention, and are not intended to limit the implementation of the invention. For those skilled in the art, modifications or changes in other forms can also be made on the basis of the above description. It is unnecessary and impossible to exhaust all implementations herein. Any modification, equivalent substitution, improvement or the like within the spirit and principle of the present invention should be included in the scope of the claims of the present invention.

The invention claimed is:

1. A low-noise light fixture reset structure, comprising:

a pivot shaft; and a pivot member rotatably connected to the pivot shaft, wherein the pivot member has a first rotation direction and a second rotation direction that are opposite in direction relative to the pivot shaft, the pivot shaft is connected with a fixed drive wheel relative to the pivot shaft and is sleeved with a shifter lever that is capable of freely rotating relative to the pivot shaft;

a first detection marker is provided on the shifter lever, and a first detector configured to detect the first detection marker is correspondingly provided on the pivot member;

a first limiting post configured to limit the shifter lever is also provided on the drive wheel, the pivot member is further provided with an elastic member capable of resisting against the shifter lever and a second limiting post configured to limit the shifter lever, an resisting end of the elastic member and the second limiting post are respectively located on two sides of the first detector, the second limiting post, the first detector and the resisting end are sequentially provided in the first rotation direction, and the second limiting post, the elastic member and the first limiting post do not interfere with each other during a relative movement between the pivot member and the pivot shaft; and when one side of the shifter lever is blocked by the first limiting post and the other side of the shifter lever squeezes the elastic member, the elastic member deforms to the second rotation direction to cause the first detector to detect the first detection marker on the shifter lever.

2. The low-noise light fixture reset structure according to claim 1, wherein a second detection marker is provided on the drive wheel, and a second detector configured to detect the second detection marker is correspondingly provided on the pivot member.

3. The low-noise light fixture reset structure according to claim 2, wherein on the pivot member, the second detector, the second limiting post, the first detector, and the resisting end are sequentially provided in the first rotation direction, and on the drive wheel, the second detection marker and the first limiting post are also sequentially provided in the first rotation direction.

4. The low-noise light fixture reset structure according to claim 2, wherein the second detection marker is a magnet, the second detector is a magnetic sensitive switch, and/or the first detection marker is a magnet, and the first detector is a magnetic sensitive switch.

5. The low-noise light fixture reset structure according to claim 2, wherein both the second detection marker and the second detector are located on one side of the drive wheel away from the shifter lever, and both the first detection marker and the first detector are located on one side of the shifter lever away from the drive wheel.

6. The low-noise light fixture reset structure according to claim 1, wherein a minimum distance between the second limiting post and a center of the pivot shaft, and a minimum distance between the elastic member and the center of the pivot shaft are both greater than a maximum distance between the first limiting post and the center of the pivot shaft.

7. The low-noise light fixture reset structure according to claim 1, wherein the second limiting post is not in contact with the shifter lever when the first detector detects the first detection marker.

8. The low-noise light fixture reset structure according to claim 1, wherein the pivot shaft is fixed, and the pivot member self-rotates about the pivot shaft.

9. The low-noise light fixture reset structure according to claim 1, wherein the pivot member is a support arm of a stage light fixture or a light head of a stage light fixture.

10. A control method of the low-noise light fixture reset structure according to claim 1, comprising the steps of:

S1, driving the pivot member to rotate in the first rotation direction relative to the pivot shaft such that the resisting end of the elastic member pushes the shifter lever to rotate together until one side of the shifter lever is blocked by the first limiting post;

S2, continuing to drive the pivot member to rotate in the first rotation direction relative to the pivot shaft, the other side of the shifter lever resists against the resisting end to deform the elastic member to the second rotation direction, thereby causing the first detector to detect the first detection marker on the shifter lever and generate a first reset signal; and S3, driving the pivot member to rotate in the second rotation direction relative to the pivot shaft, the resisting end of the elastic member resists against the shifter lever to remain motionless, and the first detector moving away from the first detection marker to complete a reset.

11. The control method according to claim 10, wherein a second detection marker is provided on the drive wheel, and a second detector that detects the second detection marker is correspondingly provided on the pivot member; and in step S3, after the first detector is moved away from the first detection marker, the pivot member is continued to be driven to rotate in the second rotation direction relative to the pivot shaft until the second detector detects the second detection marker on the drive wheel, and then a second reset signal is generated to complete a reset.

* * * * *